US010231595B2

(12) United States Patent
Ryan et al.

(10) Patent No.: US 10,231,595 B2
(45) Date of Patent: Mar. 19, 2019

(54) APPLIANCE WITH A PIN RETENTION FEATURE

(71) Applicant: General Electric Company, Schenectady, NY (US)

(72) Inventors: Jeremy Joseph Ryan, Louisville, KY (US); Jeffrey Thomas Kiesler, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 657 days.

(21) Appl. No.: 14/868,475

(22) Filed: Sep. 29, 2015

(65) Prior Publication Data

US 2017/0086644 A1 Mar. 30, 2017

(51) Int. Cl.
*A47L 15/42* (2006.01)
*F24C 15/02* (2006.01)

(52) U.S. Cl.
CPC ..... *A47L 15/4261* (2013.01); *F24C 15/023* (2013.01)

(58) Field of Classification Search
CPC ..... A47L 15/4261; F24C 15/023
USPC ..... 312/328; 126/194
See application file for complete search history.

(56) References Cited

U.S. PATENT DOCUMENTS 1,963,388 A * 6/1934 Smith ..... F24C 15/023 126/191
2,592,333 A * 4/1952 Reeves ..... F24C 15/023 126/194
2,873,737 A * 2/1959 Sherman ..... F24C 15/023 126/191
3,170,455 A * 2/1965 Gass ..... F24C 15/023 126/194
3,263,674 A * 8/1966 MacAulay ..... F24C 15/023 126/191
3,299,879 A * 1/1967 Doner ..... F24C 15/023 126/194
3,327,701 A * 6/1967 Smith ..... E05D 3/06 126/194
3,373,733 A * 3/1968 Harrington ..... F24C 15/023 126/191
3,495,582 A * 2/1970 Maier ..... F24C 15/023 126/191
5,121,824 A * 6/1992 Halsey ..... G07F 9/06 16/267
6,035,848 A * 3/2000 Ray ..... F24C 15/022 126/194
6,345,415 B1 * 2/2002 Laning ..... E05D 1/06 16/266
6,513,195 B2 * 2/2003 Haase ..... A61G 11/00 16/266

(Continued)

FOREIGN PATENT DOCUMENTS

CN 105370125 A * 3/2016
DE 3304142 A1 8/1984

(Continued)

*Primary Examiner* — Avinash A Savani
*Assistant Examiner* — Aaron H Heyamoto
(74) *Attorney, Agent, or Firm* — Dority & Manning, P.A.

(57) ABSTRACT

An appliance with a case and a door is provided. A bracket of the appliance is mounted to the case and includes a hinge slot. The hinge slot of the bracket has a channel, a tapered pin retainer and a pin opening. A pin of the door is disposed within the pin opening of the hinge slot in order to pivotally mount the door to the case.

18 Claims, 5 Drawing Sheets

(56) References Cited

U.S. PATENT DOCUMENTS

| | | | | |
|---|---|---|---|---|
| 7,836,549 | B1 * | 11/2010 | McGuigan | E05D 7/1072 16/266 |
| 9,642,511 | B2 * | 5/2017 | Shoup | A47L 15/4261 |
| 9,693,671 | B2 * | 7/2017 | Ju | A47L 15/4261 |
| 2003/0056328 | A1 * | 3/2003 | Habegger | E05F 1/1276 16/343 |
| 2004/0216274 | A1 * | 11/2004 | Morgan | E05D 3/12 16/267 |
| 2005/0034381 | A1 * | 2/2005 | Bartmann | E05B 7/00 52/79.1 |
| 2005/0134158 | A1 * | 6/2005 | Bartmann | F24C 15/023 312/319.2 |
| 2005/0189856 | A1 * | 9/2005 | Greenwald | A47B 88/43 312/334.4 |
| 2005/0257816 | A1 * | 11/2005 | Kim | A47L 15/4263 134/200 |
| 2006/0032019 | A1 * | 2/2006 | Kistner | E05D 11/1007 16/286 |
| 2006/0226742 | A1 * | 10/2006 | Gevaert | A47B 21/0073 312/7.2 |
| 2011/0187246 | A1 * | 8/2011 | Shin | A47L 15/4261 312/228 |
| 2013/0193819 | A1 * | 8/2013 | Kozinski | A47L 15/4261 312/228 |
| 2013/0291853 | A1 * | 11/2013 | Braden | E05D 7/04 126/19 R |
| 2017/0086645 | A1 * | 3/2017 | Shoup | A47L 15/4261 |

FOREIGN PATENT DOCUMENTS

| | | | | |
|---|---|---|---|---|
| DE | 10259065 | A1 * | 7/2004 | A47L 15/4261 |
| GB | 23585912 | A | 9/2003 | |
| JP | 2002143071 | A * | 5/2002 | |
| KR | 20070105044 | A * | 10/2007 | |

* cited by examiner

APPLIANCE WITH A PIN RETENTION FEATURE

FIELD OF THE INVENTION

The present subject matter relates generally to appliances, such as dishwasher appliances or oven appliances, with a door rotatably mounted to a case.

BACKGROUND OF THE INVENTION

Conventional dishwasher appliances typically include a tub that defines a washing chamber for receiving items for washing. A door mounted to the tub provides selective access to the washing chamber. The door is normally mounted to the tub using hinges that allow the door to rotate between an open configuration and a closed configuration. Conventional oven appliances may include a door mounted in a similar manner to a cabinet of the oven appliance.

To remove the door from the tub, the door may be lifted upwardly at a particular angle away from the tub. In such a manner, the door may be removed from the tub without removing locking pins or fasteners to decouple the door from the cabinet. However, the door may be inadvertently removed from the tub during service and installation by lifting upwardly on the door relative to the tub.

Accordingly, an appliance with features for limiting or hindering inadvertent removal of a door from a case of the appliance would be useful. In particular, an appliance with features for limiting or hindering inadvertent removal of a door from a case of the appliance that does not require fasteners or locking pins would be useful.

BRIEF DESCRIPTION OF THE INVENTION

The present subject matter provides an appliance with a case and a door. A bracket of the appliance is mounted to the case and includes a hinge slot. The hinge slot of the bracket has a channel, a tapered pin retainer and a pin opening. A pin of the door is disposed within the pin opening of the hinge slot in order to pivotally mount the door to the case. Additional aspects and advantages of the invention will be set forth in part in the following description, or may be apparent from the description, or may be learned through practice of the invention.

In a first exemplary embodiment, an appliance includes a case. A door has a pin, and the door is pivotable relative to the case on the pin. A bracket is mounted to the case at a bottom portion of the case. The bracket defines a hinge slot. The hinge slot of the bracket includes a tapered inlet positioned at an outer surface of the bracket, a channel disposed below the tapered inlet, a tapered pin retainer positioned below of the channel and a pin opening positioned below the tapered pin retainer. The pin of the door is disposed within the pin opening of the hinge slot.

In a second exemplary embodiment, an appliance includes a case. A door has a pin, and the door is pivotable relative to the case on the pin. A bracket is mounted to the case at a bottom portion of the case. The bracket defines a hinge slot. The hinge slot of the bracket defines a central axis and extends between a top portion and a bottom portion along the central axis. The hinge slot includes a channel, a tapered pin retainer positioned below of the channel along the central axis and a pin opening positioned below the tapered pin retainer along the central axis and at the bottom portion of the hinge slot. The pin of the door is disposed within the pin opening of the hinge slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
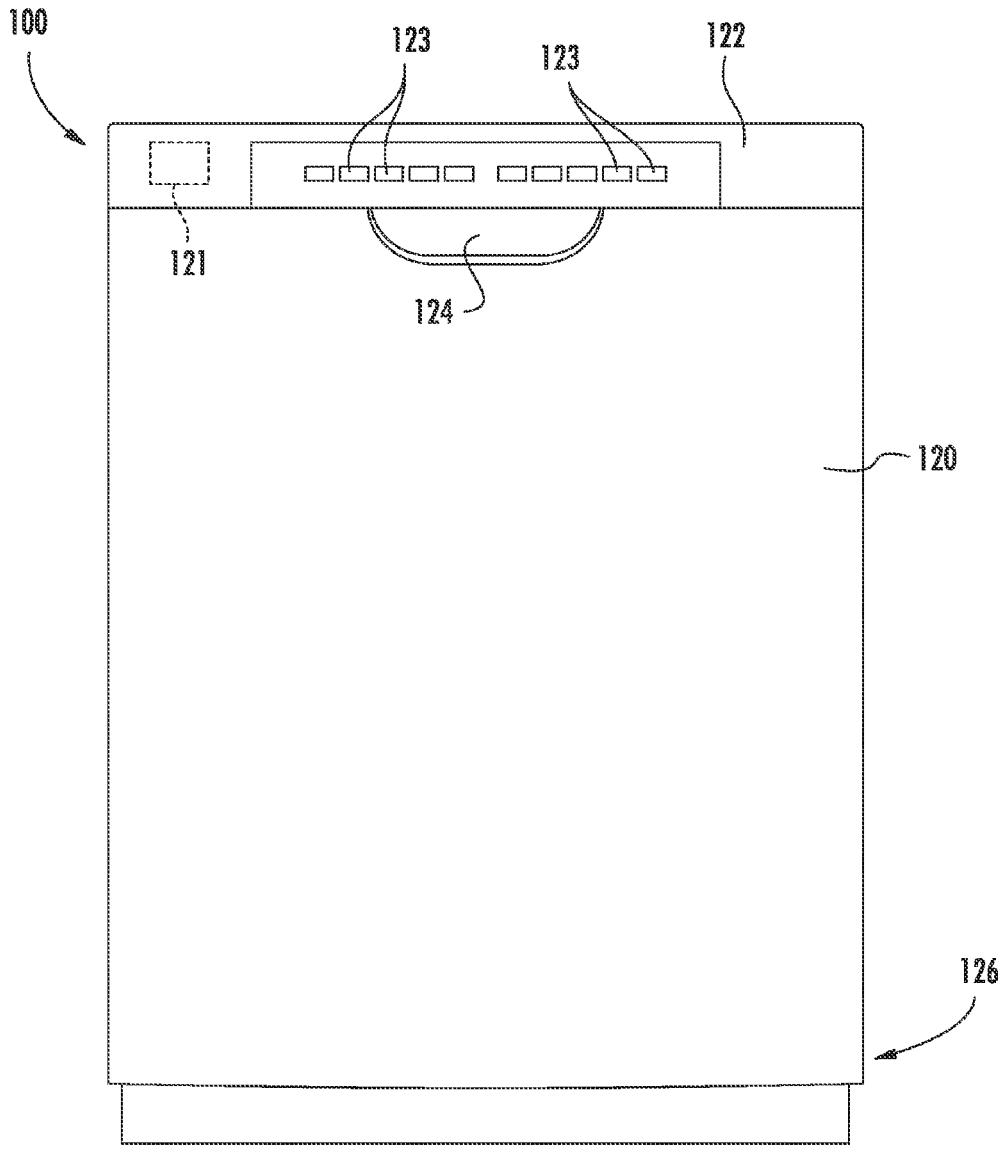
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
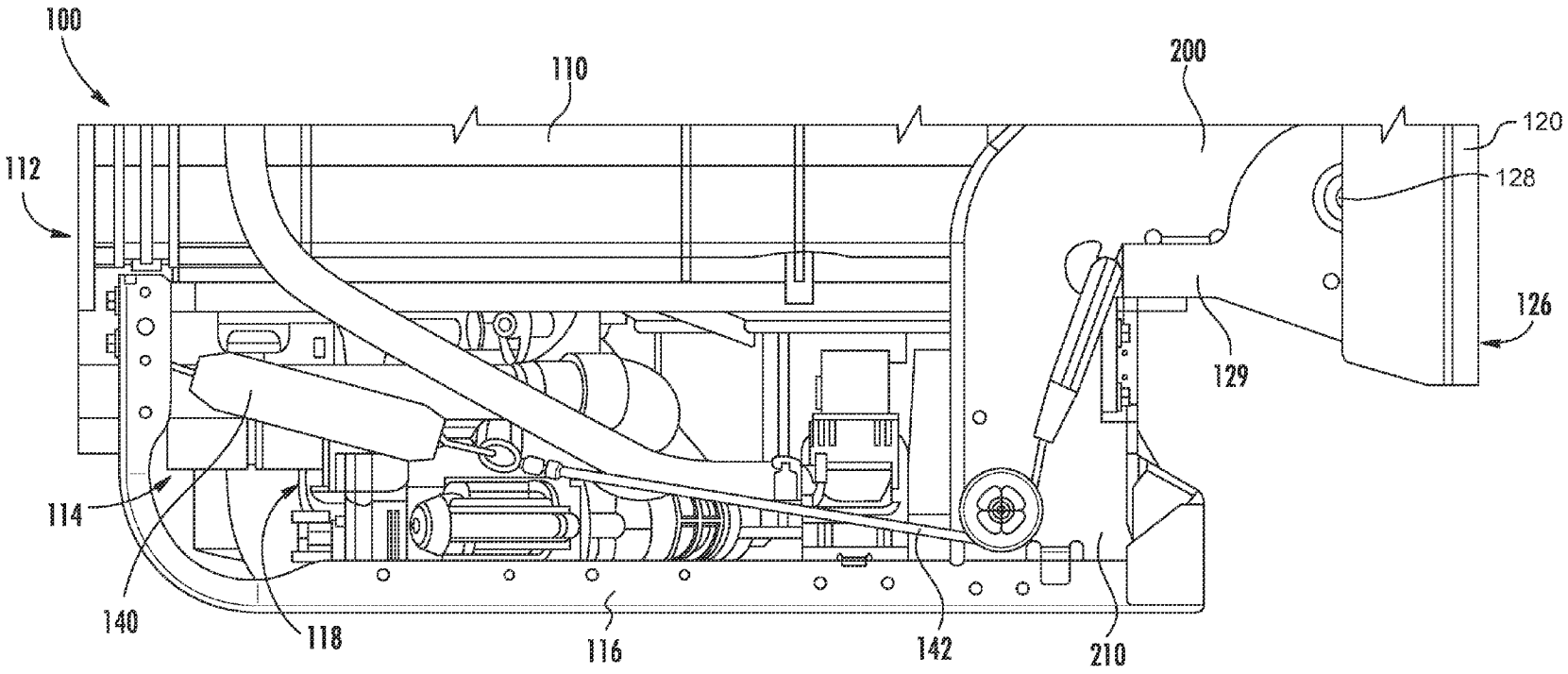
FIG. 2 provides a partial, bottom section view of the exemplary dishwasher appliance of FIG. 1.

Referring now to the drawings, FIG. 1 illustrates an exemplary embodiment of a dishwasher appliance 100 that may be configured in accordance with aspects of the present disclosure. FIG. 2 provides a partial, bottom section view of dishwasher appliance 100. It should be appreciated that the present subject matter is not limited to any particular style, model, or configuration of dishwasher appliance. The exemplary embodiment depicted in FIGS. 1 and 2 is provided for illustrative purposes only.

As shown in FIGS. 1 and 2, dishwasher appliance 100 includes a tub 110 defining a wash chamber (not shown) therein. Tub 110 may generally include a front opening (not shown) and a door 120 hinged at its bottom 126 for movement between a normally closed vertical position (shown in FIG. 1), wherein the wash chamber of tub 110 is sealed shut for washing operation, and a horizontal open position for loading and unloading of articles from dishwasher appliance 100. As shown in FIG. 1, door 120 includes a handle 124 for assisting with shifting door 120 between the open and closed positions.

As shown in FIG. 2, dishwasher appliance 100 defines a machinery compartment 114 at or below a bottom portion 112 of tub 110. Machinery compartment 114 contains various mechanical and/or electrical components of dishwasher appliance 100. For example, portions of a fluid circulation assembly 118, such as pumps, conduits, valves, a turbidity sensor, etc., are disposed within machinery compartment 114. A base rail 116 is mounted to tub 110 and extends downwardly from tub 110 within machinery compartment 114. Base rail 116 may assist with positioning tub 110 to form machinery compartment 114. For example, base rail 116 may hold tub 110 above a floor beneath dishwasher appliance 100 such that machinery compartment 114 is positioned of formed between the floor beneath dishwasher appliance 100 and tub 110.

Dishwasher appliance 100 also includes a bracket 200 that assists with rotatably mounting door 120 to tub 110. For example, a pin 128 of door 120 may be received by bracket 200 such that pin 128 may rotate within bracket 200 and thereby allow door 120 to pivot relative to tub 110 between the open and closed positions. Pin 128 may be mounted or fixed to a hinge arm 129 of door 120. A biasing spring 140 is coupled to hinge arm 129 via a cable 142 in order to assist a user with closing door 120, e.g., by urging door 120 towards the closed position. Bracket 200 may also assist with supporting tub 110. For example, a leg 210 of bracket 200 may extend downwardly from tub 110 to base rail 116 and be coupled or mounted to base rail 116 in order to support a front portion of tub 110.

Turning back to FIG. 1, dishwasher appliance 100 may be further equipped with a controller 121 configured to regulate operation of dishwasher appliance 100. Controller 121 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 121 may be positioned in a variety of locations throughout dishwasher appliance 100. In the illustrated embodiment, controller 121 is located within a control panel area 122 of door 120, as shown in FIG. 1. In such an embodiment, input/output ("I/O") signals may be routed between the control system and various operational components of dishwasher appliance 100 along wiring harnesses that may be routed through bottom 110 of door 120. Typically, controller 121 includes a user interface panel/controls 123 through which a user may select various operational features and modes and monitor progress of dishwasher appliance 100. In one embodiment, user interface 123 may represent a general purpose I/O ("GPIO") device or functional block. Additionally, user interface 123 may include input components, such as one or more of a variety of electrical, mechanical or electro-mechanical input devices including rotary dials, push buttons, and touch pads. User interface 123 may also include a display component, such as a digital or analog display device designed to provide operational feedback to a user. As is generally understood, user interface 123 may be in communication with controller 121 via one or more signal lines or shared communication busses. In response to inputs at user interface 123, controller 121 may operate various features of dishwasher appliance 100, e.g., to initiate a wash cycle for articles within tub 110. For example, controller 121 may activate a pump of fluid circulation assembly 118 to spray wash fluid within tub 110 or drain wash fluid from dishwasher appliance 100.

Figure 3:
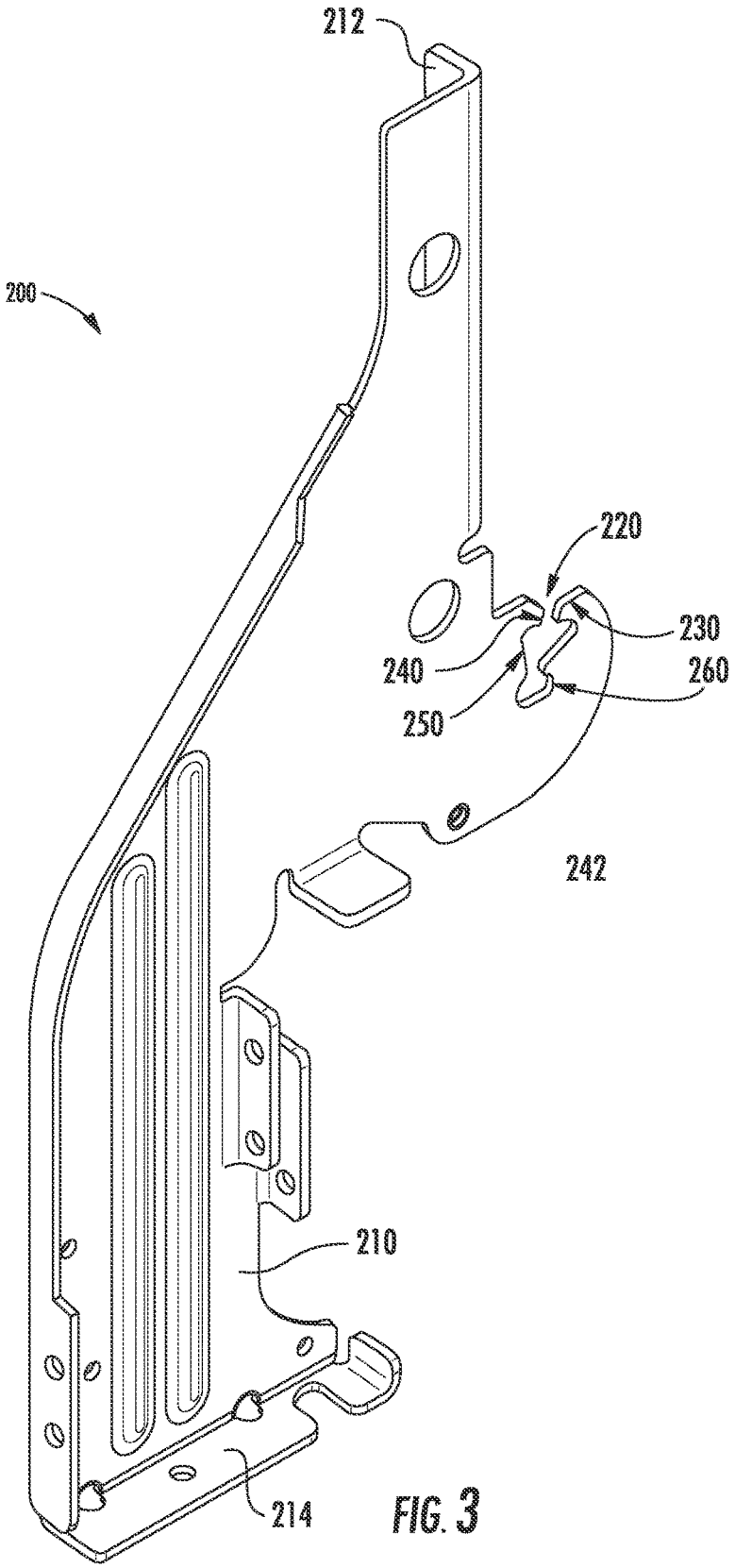
FIG. 3 provides a perspective view of a bracket of the exemplary dishwasher appliance of FIG. 1.
Figure 4:
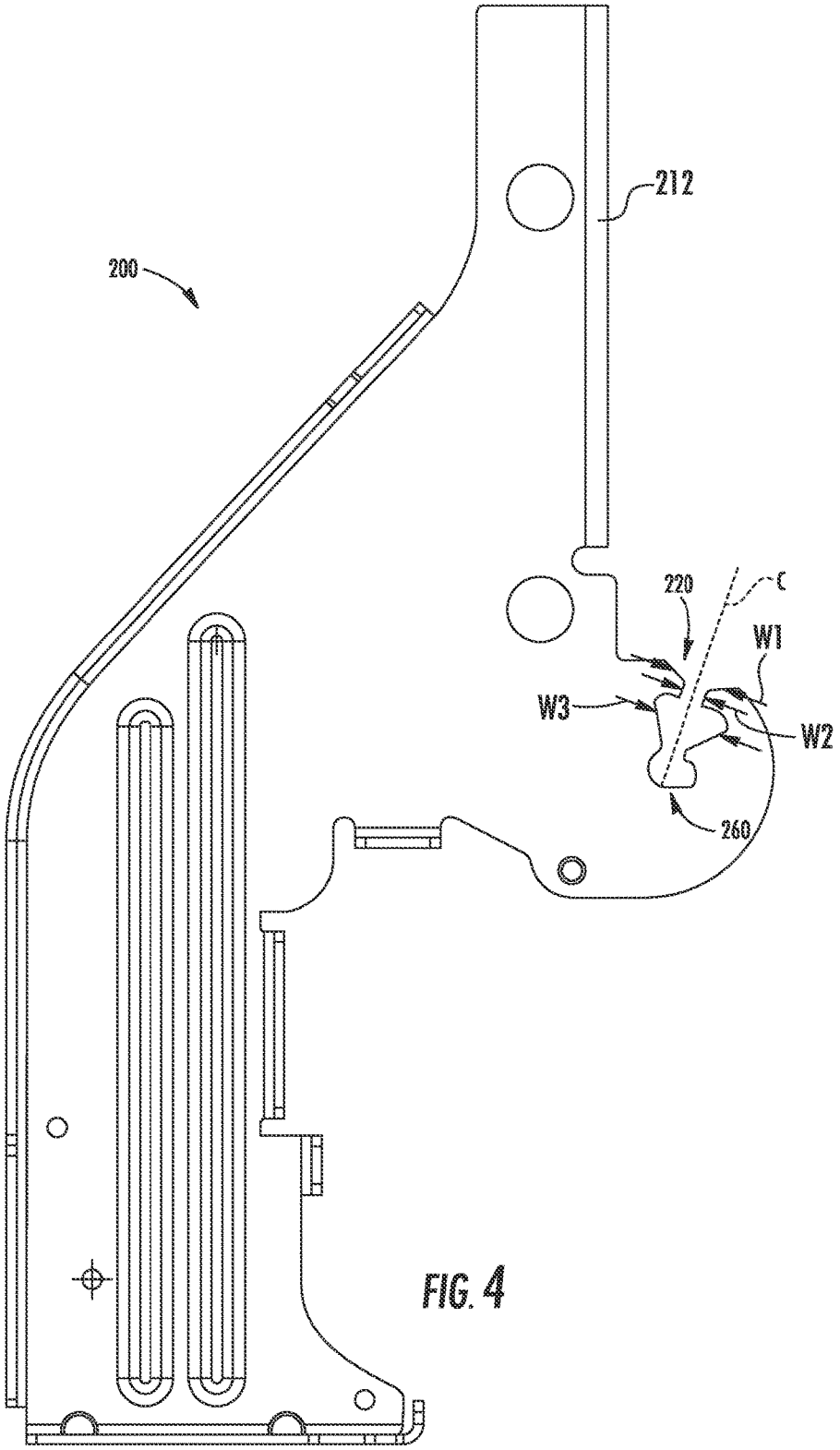
FIG. 4 provides a side, elevation view of the bracket of FIG. 3.

FIG. 3 provides a perspective view of bracket 200. FIG. 4 provides a side, elevation view of bracket 200. While described in greater detail below in the context of dishwasher appliance 100, it should be understood that bracket 200 may be used in or with any suitable appliance in alternative exemplary embodiments. Thus, bracket 200 may also be used in or with appliances other than dishwasher appliances. For example, bracket 200 may be used in or with oven appliances, range appliances, etc.

As may be seen in FIGS. 3 and 4, bracket 200 may include a leg 210, a top mounting plate 212 and a bottom mounting plate 214. Leg 210 extends downwardly, e.g., to base rail 116. Thus, leg 210 may assist base rail 116 with supporting tub 110 at a front portion of tub 110 below door 120. It should be understood that bracket 200 need not include leg 210 in certain exemplary embodiments. For example, when utilized with a wall oven appliance, bracket 200 need not include leg 210.

Top mounting plate 212 may be generally horizontally oriented at a top portion of bracket 200, and bottom mounting plate 214 may be generally vertically oriented at a bottom portion of bracket 200. Top mounting plate 212 may be positioned on and/or coupled to tub 110. For example, fasteners, such as bolts, screws, etc., may extend through top mounting plate 212 and tub 110 in order to couple or mount bracket 200 to tub 110. Bottom mounting plate 214 may be positioned on and/or coupled to base rail 116. For example, fasteners, such as bolts, screws, etc., may extend through bottom mounting plate 214 and base rail 116 in order to couple or mount bracket 200 to base rail 116.

As may be seen in FIGS. 3 and 4, bracket 200 also defines a hinge slot 220. Hinge slot 220 is configured for receiving and retaining pin 128 of door 120, e.g., such that pin 128 is rotatable within hinge slot 220. Thus, bracket 200 assists with pivotally mounting door 120 on tub 110. Hinge slot 220 includes features for assisting with maintaining or retaining pin 128 within hinge slot 220, as discussed in greater detail below. Top mounting plate 212 may be positioned or formed above hinge slot 220 and bottom mounting plate 214 may be positioned or formed below hinge slot 220 (e.g., on leg 210), as shown in FIGS. 3 and 4.

Bracket 200 may be formed of or with any suitable material. For example, bracket 200 may be formed of stamped and bent sheet metal. The sheet metal may be steel or any other suitable metal. The sheet metal may have a thickness of about a tenth of an inch. As used herein the term "about" means within ten percent of the stated thickness when used in the context of thicknesses.

Figure 5:
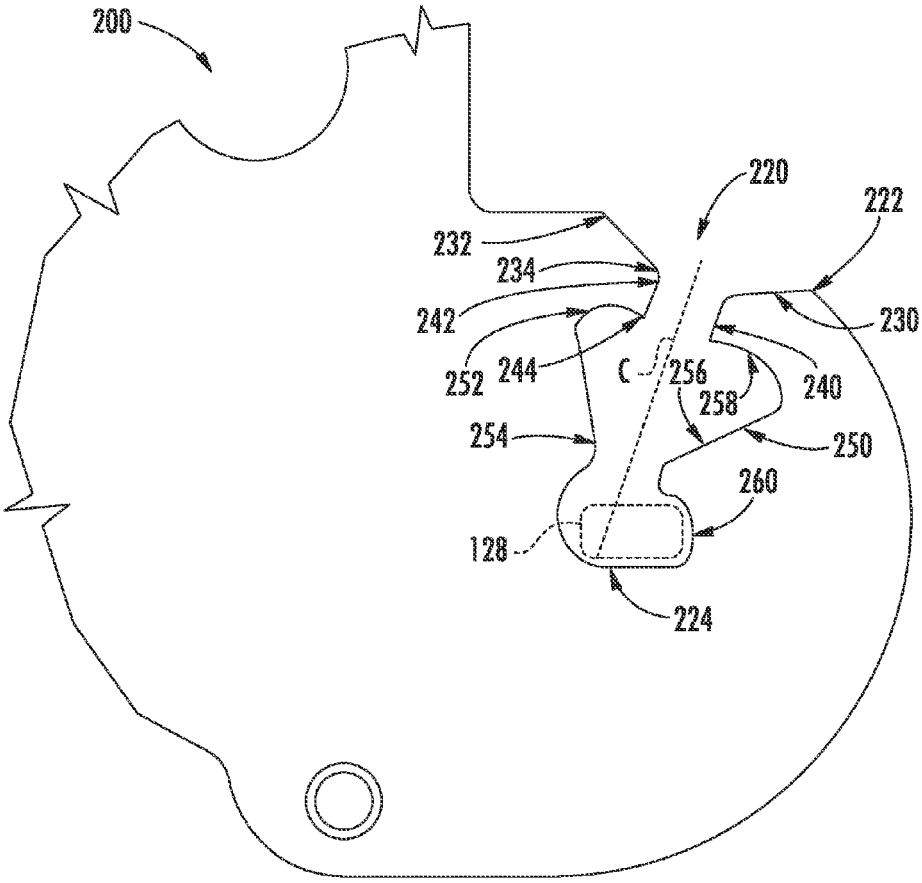
FIG. 5 provides a partial side, elevation view of a hinge slot of the bracket of FIG. 3.

FIG. 5 provides a partial side, elevation view of hinge slot 220 of bracket 200. As may be seen in FIG. 5, hinge slot 220 defines a central axis C. Hinge slot 220 also extends between a top portion 222 and a bottom portion 224, e.g., along the central axis C. Hinge slot 220 includes various slots, passages or channels for guiding and/or limiting motion of pin 128 within hinge slot 220. In particular, hinge slot 220 includes a tapered inlet 230, a channel 240, a tapered pin retainer 250 and a pin opening 260. Such features for hinge slot 220 are discussed in greater detail below in the context of FIGS. 4 and 5.

As may be seen in FIG. 5, tapered inlet 230 is positioned at top portion 222 of hinge slot 220, and pin opening 260 is positioned at bottom portion 224 of hinge slot 220. Thus, a top portion 232 of tapered inlet 230 is positioned at or adjacent an outer surface of bracket 200, and pin opening 260 is positioned within bracket 200. Channel 240 is positioned below tapered inlet 230 on the central axis C. For example, an upper portion 242 of channel 240 may be contiguous with tapered inlet 230 at a bottom portion 234 of tapered inlet 230. Tapered pin retainer 250 is positioned below channel 240 on the central axis C. For example, an upper portion 252 of tapered pin retainer 250 may be contiguous with channel 240 at a lower portion 244 of channel 240. Pin opening 260 is positioned below tapered pin retainer 250 on the central axis C. For example, a lower portion 254 of tapered pin retainer 250 may be contiguous with pin opening 260. As shown in FIG. 5, pin opening 260 may correspond to the lowest portion of hinge slot 220.

When door 120 is mounted to tub 110 as shown in FIG. 1, pin 128 of door 120 is disposed or received within pin opening 260 of hinge slot 220 such that bracket 200 supports door 120 on tub 110. The position and sizing of channel 240, tapered pin retainer 250 and/or pin opening 260 of hinge slot 220 may assist with maintaining pin 128 within hinge slot 220. Turning back to FIG. 4, widths of the various portions of hinge slot 220 may be selected or sized to assist with retaining pin 128 within hinge slot 220 and, e.g., guiding pin 128 into hinge slot 220. As shown in FIG. 4, tapered inlet 230 defines a width, W1, e.g., perpendicular to the central axis C. Similarly, channel 240 defines a width, W2, e.g., perpendicular to the central axis C, and tapered pin retainer 250 defines a width, W3, e.g., perpendicular to the central axis C.

The width W1 of tapered inlet 230 decreases from top portion 232 of tapered inlet 230 to bottom portion 234 of tapered inlet 230. Thus, tapered inlet 230 may contract along the central axis C between upper and lower portions 232, 234 of tapered inlet 230. In such a manner, during insertion of pin 128 into hinge slot 220, tapered inlet 230 guides or directs pin 128 into hinge slot 220, e.g., into channel 240 of hinge slot 220. Conversely, the width W2 of channel 240 may be constant along the central axis C2. Thus, channel 240 may be straight or linear between tapered inlet 230 and tapered pin retainer 250.

As shown in FIG. 5, pin 128 may have a non-circular cross-sectional shape, e.g., in a plane that is parallel to the central axis C. As an example, pin 128 may have a generally oval or stadium-shaped cross-section, e.g., in a plane that is parallel to the central axis C. Pin opening 260 may have a shape that is complementary to pin 128, e.g., an oval shape. When door 120 is open or closed, pin 128 is oriented within pin opening 260 such that pin 128 cannot move from pin opening 260 into tapered pin retainer 250 due to the sizing of tapered pin retainer 250 at lower portion 254 of tapered pin retainer 250. In particular, the width W3 of tapered pin retainer 250 at lower portion 254 of tapered pin retainer 250 may be less than a width of pin 128 along a central or major axis of pin 128. Conversely, when door 120 is suitably positioned between then open and closed positions, the central or major axis of pin 128 may be aligned with the central axis C of hinge slot 220 in order to permit removal of pin 128 from pin opening 260 into portions of hinge slot 220 above pin opening 260, e.g., tapered pin retainer 250, and out of hinge slot 220. Thus, the width W3 of tapered pin retainer 250 at lower portion 254 of tapered pin retainer 250 may be greater than a width of pin 128 along an axis that is perpendicular to the central or major axis of pin 128.

To avoid undesired or inadvertent removal of pin 128 from hinge slot 220, tapered pin retainer 250 is provided above pin opening 260. As may be seen in FIG. 4, the width W3 of tapered pin retainer 250 decreases from upper portion 252 of tapered pin retainer 250 to lower portion 254 of tapered pin retainer 250. Thus, tapered pin retainer 250 may contract along the central axis C between upper and lower portions 252, 254 of tapered pin retainer 250 in order to hinder inadvertent removal of pin 128 from hinge slot 220. For example, if pin 128 is inadvertently removed from pin opening 260, pin 128 is directed into tapered pin retainer 250 where pin 128 slides along walls of tapered pin retainer 250 rather than passing through channel 240 (e.g., unless pin 128 aligns with channel 240). Thus, providing tapered pin retainer 250 may assist with limiting inadvertent removal of pin 128 from hinge slot 220. As shown in FIG. 5, tapered pin retainer 250 may be shaped such that tapered pin retainer 250 has linear side walls 256 and arcuate top walls 258, e.g., such that tapered pin retainer 250 is cuneate or has an inverted bell or spade shape, to assist with limiting inadvertent removal of pin 128 from hinge slot 220.

The width W1 of tapered inlet 230, the width W2 of channel 240 and the width W3 of tapered pin retainer 250 may be any suitable widths. For example, the width W1 of tapered inlet 230 at bottom portion 234 of tapered inlet 230, the width W2 of channel 240 and/or the width W3 of tapered pin retainer 250 at lower portion 254 of tapered pin retainer 250 may be no greater than seven-tenths of an inch. In turn, the width of pin 128 along a central or major axis of pin 128 may be no less than seven-tenths of an inch. Such sizing of tapered inlet 230, channel 240 and/or tapered pin retainer 250 may assist with limiting or preventing inadvertent removal of pin 128 from hinge slot 220 while permitting intentional removal of pin 128 from hinge slot 220. A maximum width W3 of tapered pin retainer 250 may also be larger than the width W2 of channel 240. For example, the maximum width W3 of tapered pin retainer 250 may be no less than twice the width W2 of channel 240. As another example, the maximum width W3 of tapered pin retainer 250 may be no less than three times the width W2 of channel 240

Bracket 200 may permit door 120 to be easily mounted to tub 110 by dropping pin 128 into hinge slot 220, e.g., without requiring fasteners or locking pins. To remove door 120 from tub 110, pin 128 may be aligned with and removed along the central axis C of hinge slot 220. As a result, pin 128 can easily be pulled out of hinge slot 220 in the same manner that it drops in. However, inadvertent removal of door 120 from tub 110 is avoided or limited because movement of pin 128 along a direction that is not parallel to the central axis C results in capture of pin 128 within tapered pin retainer 250 of hinge slot 220. In such a manner, potential damage to door 120 and/or other portions of dishwasher appliance 100 can be avoided.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a case;

a door having a pin, the door pivotable relative to the case on the pin;

a bracket mounted to the case at a bottom portion of the case, the bracket defining a hinge slot, the hinge slot of the bracket comprising a tapered inlet positioned at an outer surface of the bracket;

a channel disposed below the tapered inlet;

a tapered pin retainer positioned below of the channel; and a pin opening positioned below the tapered pin retainer, the pin of the door disposed within the pin opening of the hinge slot, wherein the hinge slot defines a central axis between the tapered inlet and the pin opening, wherein the tapered pin retainer defines a width perpendicular to the central axis, the width of the tapered pin retainer decreasing from a top portion of the tapered pin retainer to a bottom portion of the tapered pin retainer, and wherein a maximum width of the tapered pin retainer is no less than twice a width of the channel that is perpendicular to the central axis.

2. The appliance of claim 1, wherein the channel is contiguous with the tapered inlet at a top portion of the channel, the tapered pin retainer is contiguous with the channel at a top portion of the tapered pin retainer and the pin opening is contiguous with the tapered pin retainer at a top portion of the pin opening.

3. The appliance of claim 1, wherein the hinge slot extends between a top portion and a bottom portion along the central axis, the tapered inlet positioned at the top portion of the hinge slot, the pin opening positioned at the bottom portion of the hinge slot.

4. The appliance of claim 3, wherein the tapered inlet defines a width perpendicular to the central axis, the width of the tapered inlet decreasing from a top portion of the tapered inlet to a bottom portion of the tapered inlet.

5. The appliance of claim 1, wherein the width of the tapered pin retainer is no greater than seven-tenths of an inch.

6. The appliance of claim 3, wherein the channel defines a width perpendicular to the central axis, the width of the channel being constant along the central axis.

7. The appliance of claim 1, wherein the tapered pin retainer comprises linear side walls and arcuate top walls.

8. The appliance of claim 1, wherein the pin has a non-circular cross-sectional shape.

9. The appliance of claim 1, wherein the bracket is constructed of stamped sheet metal.

10. An appliance, comprising:

a case;

a door having a pin, the door pivotable relative to the case on the pin;

a bracket mounted to the case at a bottom portion of the case, the bracket defining a hinge slot, the hinge slot of the bracket defining a central axis and extending between a top portion and a bottom portion along the central axis, the hinge slot comprising a channel;

a tapered pin retainer positioned below of the channel along the central axis; and a pin opening positioned below of the tapered pin retainer along the central axis and at the bottom portion of the hinge slot, the pin of the door disposed within the pin opening of the hinge slot, wherein the pin has a non-circular cross-sectional shape.

11. The appliance of claim 10, wherein the hinge slot further comprises a tapered inlet positioned at the top portion of the hinge slot, the channel disposed below the tapered inlet on the central axis.

12. The appliance of claim 10, wherein the channel is contiguous with the tapered inlet, the tapered pin retainer is contiguous with the channel and the pin opening is contiguous with the tapered pin retainer.

13. The appliance of claim 10, wherein the tapered inlet defines a width perpendicular to the central axis, the width of the tapered inlet decreasing from a top portion of the tapered inlet to a bottom portion of the tapered inlet.

14. The appliance of claim 10, wherein the tapered pin retainer defines a width perpendicular to the central axis, the width of the tapered pin retainer decreasing from a top portion of the tapered pin retainer to a bottom portion of the tapered pin retainer.

15. The appliance of claim 14, wherein the width of the tapered pin retainer is no greater than seven-tenths of an inch.

16. The appliance of claim 10, wherein the channel defines a width perpendicular to the central axis, the width of the channel being constant along the central axis.

17. The appliance of claim 10, wherein the tapered pin retainer comprises linear side walls and arcuate top walls.

18. The appliance of claim 10, wherein the bracket is constructed of stamped sheet metal.

* * * * *